US006795529B1

(12) United States Patent
Barnes et al.

(10) Patent No.: US 6,795,529 B1
(45) Date of Patent: Sep. 21, 2004

(54) HIGH RATIO, HIGH EFFICIENCY GENERAL RADIOGRAPHY GRID SYSTEM

(76) Inventors: Gary T. Barnes, 2250 Shady Creek Trail, Birmingham, AL (US) 35216; David M. Gauntt, 403 Poinciana Dr, Homewood, AL (US) 35209

( * ) Notice: Subject to any disclaimer, the term of this patent is extended or adjusted under 35 U.S.C. 154(b) by 198 days.

(21) Appl. No.: 10/224,134

(22) Filed: Aug. 20, 2002

Related U.S. Application Data

(60) Provisional application No. 60/313,910, filed on Aug. 21, 2001.

(51) Int. Cl.[7] ..... G21K 1/00
(52) U.S. Cl. ..... 378/155
(58) Field of Search ..... 378/154, 155

(56) References Cited

U.S. PATENT DOCUMENTS 1,164,987 A 12/1915 Bucky et al.
4,340,818 A 7/1982 Barnes

OTHER PUBLICATIONS

Potter, Hollis E., M.D. Analysis of the Flat Grid and Some Less Excentric Forms. Journal of Radiography, vol. XXV No. 5, p. 677–683.

Sorenson, JA., Niklason, LT, Jacobsen, SC, Knutti, DF and Johnson, TC. Tantalum Air Interspace Crossed Grid: Design and Performance Characteristics. Radiation Physics, vol. 145 No. 2, p. 485–492.

Barnes, GT, Moreland RF, Yester MV and Whittedn DM. The Scanning Grid: A Novel and Effective Bucky Movement. Radiology, vol. 135 No. 3, pp. 765–767.

*Primary Examiner*—Craig E. Church
(74) *Attorney, Agent, or Firm*—Bradley Arant Rose & White LLP

(57) ABSTRACT

Disclosed is an X-ray imaging system that comprises a high ratio, high primary transmission anti-scatter grid in combination with a dynamic X-ray tube output function to eliminate or reduce gridline artifacts. Conventional X-ray imaging systems utilizing conventional anti-scatter grids generally require that the grid be moved a distance of at least 20 grid pitches to eliminate gridline artifacts. Through the use of the anti-scatter grid and dynamic output function described, such artifacts are eliminated or substantially reduced when the grid travels a short distance. Any function that has zero frequency components at positive integer multiples of the reciprocal of the grid repeat time will completely suppress gridline artifacts. Any function that is equal to the convolution of an arbitrary function with a rect function whose width is a positive multiple of the grid repeat time will fit this criterion, and its use will completely suppress gridline artifacts.

43 Claims, 12 Drawing Sheets

HIGH RATIO, HIGH EFFICIENCY GENERAL RADIOGRAPHY GRID SYSTEM

This patent application claims priority to U.S. Provisional Patent Application No. 60/313,910, filed Aug. 21, 2001.

FIELD

The present disclosure relates to X-ray imaging and, more particularly, to a dynamic X-ray tube output function combined with a high-ratio, high primary transmission grid system for use in general radiography.

BACKGROUND

Transmission X-ray imaging involves a point source (sometimes referred to as a focus or X-ray focus) of X-rays and a collimator to limit the X-rays to the region of interest. When the X-rays pass through the object, X-ray attenuation differences due to structures in the object give rise to differences in transmitted X-ray intensity. These intensity differences are in turn detected by an image receptor giving rise to the detected X-ray image. The detected X-ray image is comprised of two parts. The primary image consists of detected X-rays that have traveled on a straight-line path from the source to the image receptor. The secondary image consists of detected X-rays that have interacted with atoms and electrons in the object and were deflected or scattered from their original path (scattered X-rays). These scattered X-rays form a diffuse, out-of-focus image that is superimposed on the primary image. X-ray image contrast is reduced by scattered X-rays with the problem becoming more acute as the thickness and density of the object being imaged increases. In many applications of medical radiography the ratio of the scattered to primary X-rays can be quite large. For example, in abdominal radiography this ratio can exceed 10:1, causing a severe loss of subject contrast. Therefore, for maximum image contrast, it is important to reduce the contribution of scattered radiation to the detected X-ray image to a minimum.

In 1915 anti-scatter grids were introduced to improve image contrast in general radiography (G. Bucky, Method and Apparatus for Projecting Roentgen images, U.S. Pat. No. 1,164,987). As illustrated in FIG. 1, a conventional anti-scatter grid consists of an array of radiopaque foil strips or septa, interspersed with strips of radiolucent interspace material. The septa are composed of material that absorbs X-rays, such as, but not limited to lead, while the interspace material is composed of material that does not substantially absorb X-rays, such as, but not limited to, aluminum, polycarbonate fibers or paper. The width of the individual septa are indicated in FIG. 1 as "d," while the width of the interspace material is indicated as "D." By combining the width of the septa ("d") and the interspace material ("D"), the grid pitch, or grid period, can be determined ("d +D").

The grid is positioned in the X-ray beam after the object so that the X-rays traveling in a straight-line path from the focus through the patient to the image receptor (primary X-rays) strike only the edges of the radiopaque septa. The septa are thus projected onto the image receptor as lines. To address this issue, during an exposure the grid is commonly moved orthogonal to the lines through a distance of at least 20 grid pitches to blur out the X-ray shadows of the lines. When these shadows are not eliminated, the result is an image flaw known as a "gridline artifact." On the other hand, scattered X-rays do not travel in a straight line from the focus to the image receptor, but are deflected within the patient and approach the grid at an angle, and have a much greater probability of striking the sides of the septa and being absorbed. As a result, the contribution of scattered X-rays to the detected X-ray image is reduced and the image contrast is improved. Conventional general radiography grids typically absorb 30% to 50% of the primary X-rays, and 85% to 95% of the scattered X-rays.

A variety of techniques have been suggested for suppressing gridline artifacts. The simplest is to use a high line density grid, in which the number of septa per centimeter is sufficiently high that the image receptor is incapable of recording the image of the grid lines. Alternately, the grid can be moved during the exposure. The motion of the grid has the effect of blurring the grid line artifacts, reducing their visibility on the final image. Typically, the grid needs to be moved by more than 20 times the grid pitch in order to adequately suppress the grid line artifacts; however, given a constant tube output during the exposure the artifacts can be completely suppressed by moving the grid any integral number of grid pitches.

One problem with moving the grid is that the available distance is limited, and it is possible during long exposures for the grid to run out of travel space. The direction of motion can then be reversed, but this raises the possibility of a gridline artifact to develop while the grid is stationary. One technique that has been developed and is in clinical use is to use a variable velocity. The grid is moved quickly during the start of the exposure, guaranteeing that even for short exposures the grid moves at least 20 times the grid pitch. Then the grid is progressively slowed, to ensure that even for long exposures the grid does not reach the end of its travel space.

In 1931 Potter suggested a technique he described as "feathering"(H. E. Potter, *Am. J. Roent.*, Vol XXV (May 1931), pp. 677–683). In this approach the tube output is gradually increased at the beginning of an exposure and gradually decreased at the end of the exposure. This has the effect of blurring the edges of the grid line artifacts. However, Potter did not describe how to accomplish the feathering, and did not implement this approach on a clinical x-ray machine.

In general radiography, the anti-scatter grid is typically integrated into the radiographic examination table. The X-rays pass successively through a) the patient, b) the table top, c) the anti-scatter grid, d) the automatic exposure control (AEC) sensor, and e) the image receptor.

The AEC sensor is used to measure the amount of radiation (X-rays) that has reached the image receptor. This allows the X-ray generator to terminate the exposure when the desired exposure level has been reached.

The efficiency of an anti-scatter grid is reduced if it is not properly aligned. For a properly made grid, the primary planes of the septa all intersect along a line known as the focal axis (FIG. 2A). The distance from the focal axis to the grid is the focal length of the grid. When the grid 5 is properly aligned (FIG. 2A), the focal spot 4 lies on the focal axis 6, and any x-rays traveling directly from the focal spot (primary x-rays) either pass between the septa or strike the septa edge and are absorbed. In this orientation, the projections of the septa on the image receptor are minimized. If the grid 5 is not aligned (FIG. 2B), then the focal spot 4 does not lie on the focal axis 6, a fraction of the primary x-rays strike the sides of the septa, and a higher fraction of the primary X-rays are attenuated than desired. This condition can be caused by poor initial positioning, but can also occur when the grid is moved to blur the septa shadows, when there are manufacturing defects in the grid, or when the distance from the focus to the grid changes from its ideal value.

Grid ratio is an important parameter in determining the effectiveness of an anti-scatter grid. Grid ratio is defined as the ratio of the height of the radiopaque septa (indicated as "h" in FIG. 1) to the interspace distance between septa (the width of the interspace material, indicated as "D" in FIG. 1). The higher the grid ratio, the more efficient the grid is in controlling scattered X-rays. However, as the grid ratio increases, grid alignment difficulties are compounded. Also, if the grid ratio of a conventional grid is increased by increasing the height of the septa ("h"), attenuation of the primary X-rays by the interspace material increases. If the grid ratio is increased by decreasing the interspace distance ("D") without a corresponding decrease in the thickness of the individual septa ("d"), attenuation of the primary X-rays by the septa increases. Typically, in general radiography the grid ratios range from 8:1to 16:1, and the strip densities range from 30 to 60 septa per centimeter. Previous attempts at using conventional higher ratio grids have met with limited success because the advantage of increased scatter control has been largely offset by the increased attenuation of the primary X-rays and by alignment difficulties.

The realization of these limitations of conventional anti-scatter grids in general radiography has led to the development of alternative anti-scatter techniques. The scanning multiple slit assembly is representative of these techniques and virtually eliminates scatter at the expense of limitations in the ability to position the subject being imaged. In this method, multiple pre-patient slits and post-patient articulated slots are scanned across the image receptor (as described in U.S. Pat. No. 4,096,391). Images acquired through this technique display significantly more contrast than images acquired under the same conditions with a conventional grid (G. T. Barnes, I. A. Brezovich and D. M. Witten, *AJR* 129:497–501, 1977; G. T. Barnes and I. A. Brezovich, *Med Phys* 6:197–204, 1979).

Alternatively X-ray image quality can be improved by employing more efficient grids. The scanning grid is one such approach, and consists of articulating radiopaque septa, or slats, situated between the patient and image receptor. Air is used as the interspace material with increased septa height ("h") (and therefore a higher grid ratio) without an increase in the primary X-ray attenuation. To ensure adequate rigidity of the grid, it was necessary to make the septa fairly thick (high value of "d"). Consequently, to ensure low primary attenuation it was necessary to use a coarse grid spacing (high value of "D", ~5 mm/septa). During an exposure the septa scan the radiation field and articulate so that they remain focused on the x-ray focus. Focusing is realized by making the lower septa spacing equal to the geometrical projection of the upper septa spacing. During an exposure, both the upper and lower septa spacers move, with the lower septa spacer moving faster by the difference in spacing to maintain alignment with the focal spot. Such systems have proven to be highly effective in controlling scatter (G. T. Barnes, R. F. Moreland, M. V. Yester, *Radiology* 135:765–767, 1980;G. T. Barnes: Scanning Grid Apparatus for Suppressing Scatter in Radiographic Imaging. U.S. Pat. No. 4,340,818). However, in order to eliminate gridline artifacts these grids needed to be scanned through a distance of more than twenty times the grid pitch (the sum of "d +D"). The limitation of these systems is that they are large, have a substantial mass and have to be accelerated to a velocity of ~50 cm per second to move through ~20 grid pitches during a short exposure time (~0.2 second). A scanning grid system that is less massive, more compact and does not require such high accelerations and velocities would have a number of practical advantages.

The linear grids thus described preferentially absorb scattered X-rays that travel across the septa, and preferentially transmit scattered X-rays that travel along the septa. U.S. Pat. No. 1,164,987 taught a cellular anti-scatter grid. This comprises two sets of linear septa that intersect each other at right angles. The X-rays that are preferentially transmitted by one set of septa are preferentially absorbed by the other set. Consequentially, the transmission of scattered X-rays through a cellular grid is lower than for a linear grid of similar grid ratio.

U.S. Pat. No. 5,606,589 teaches a practical implementation of the cellular grid. A plurality of thin copper foil sheets are photo etched to create a square array of air holes and septa. The etched sheets are aligned and bonded to form laminated two-dimensional focused grid panels. These grid panels typically have a grid ratio of 2.4–3.5:1. Applications of a two-dimensional photo-etched grid have been limited by high manufacturing costs and relatively low grid ratio. The grid ratio is limited both by the difficulty in manufacturing and by the problem of grid alignment.

A similar technique that can be used to reduce scatter is to use two lower-ratio grids mounted orthogonally to each other (J. A. Sorenson, L. T. Niklason, S. C. Jacobsen, et al, Radiology 145:485–492, 1982). To blur out grid lines both grids have to be move in directions orthogonal to each other a slightly different speeds and the system proved to be too complex and bulky to gain wide spread clinical acceptance.

Important to the present disclosure is control of the tube current of the X-ray tube. The tube current in a given tube is determined primarily by the filament temperature and to a lesser degree by the X-ray tube voltage. The filament temperature is in turn determined by the filament current; however, the filament temperature changes slowly in response to changes in filament current, with characteristic times of tens to hundreds of milliseconds. Before 1970, X-ray generator designs utilized open-loop control of the tube current. The filament current necessary to achieve a desired tube current was set during calibration. Just prior to an exposure the filament current was turned on and it was maintained throughout the exposure.

More recent X-ray generator designs utilize closed-loop control of the tube current (W. T. Sobol, Med. Phys. 29(2), Febuary 2002, pp. 132–144). This is accomplished by incorporating an electronic circuit that measures the tube current and compares it to the desired tube current. The filament current is then automatically adjusted to achieve the desired filament temperature and tube current.

In view of image contrast limitations and the prior art, there exists a need for spatially compact, high-ratio, high primary transmission anti-scatter grid systems. A particular need exists in the field of abdominal radiography, where the ratio of scattered to primary radiation in the spine on larger patients can exceed 20:1, and in the field of chest radiography, where in the mediastinum the ratio of scattered to primary radiation can also exceed 20:1.

DETAILED DESCRIPTION

Figure 3:
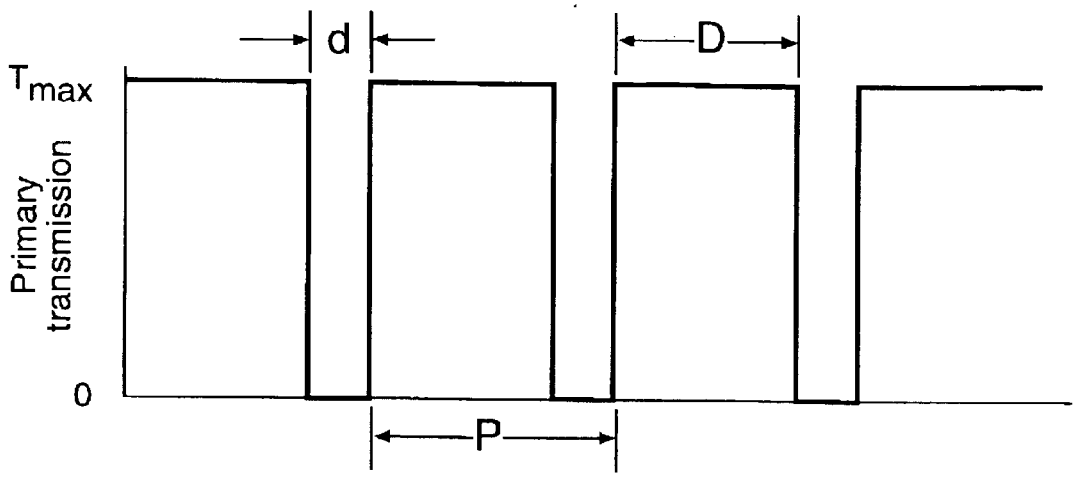
FIG. 3 is a graph indicating the grid transmission function for a conventional anti-scatter grid.

The theory and formation of gridline artifacts is well established (D. R. Bednareck, *Radiology* 147:255–258, 1983; M. A. King and G. T. Barnes, *Med. Phys.* 10:4–9, 1983, D. M. Gauntt and G. T. Barnes, submitted to *Med. Phys.*,2002). As discussed above, the use of an anti-scatter grid in an X-ray imaging system can create a gridline artifact, which is a visible X-ray shadow of the septa of the grid. For example, suppose that a stationary anti-scatter grid is placed over the image receptor. The intensity of the primary X-ray radiation falling on the image receptor would then be proportional to the grid transmission function, which describes the transmission of primary X-rays through the grid as a function of position. A typical grid transmission function is shown in FIG. 3. Under the grid septa (indicated in FIG. 3 as "d"), the transmission function is zero because the septa absorb essentially all of the primary X-rays. Under the interspace material (indicated in FIG. 3 as "D"), the function is a uniform value ($T_{max}$) as close to 100% as possible since the interspace materially allows a substantial portion of the X-rays to pass through. The grid pitch (which equals "d +D") is defined as "P." Depending on the precise application, the grid is periodic either in linear distance or in angular distance. The angular distance refers to the angle between the center of the grid and a position on the grid, referenced back to the focal axis. A grid designed for linear motion is built to be periodic in linear distance; one designed for pendulous motion is built to be periodic in angular distance.

Figure 4:
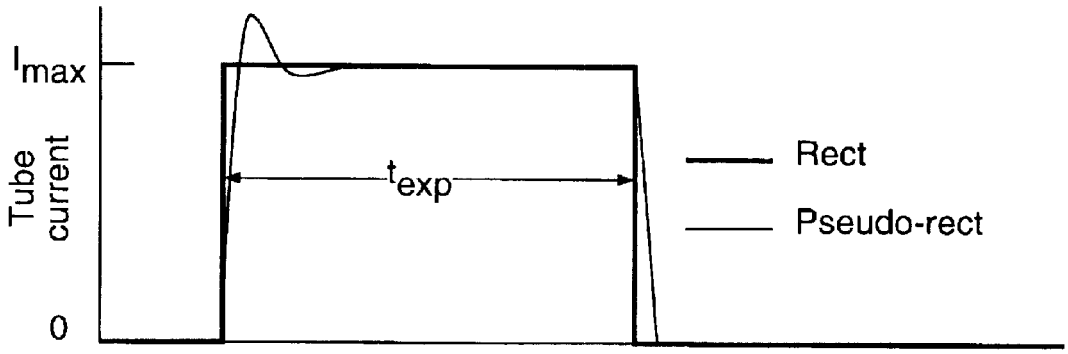
FIG. 4 illustrates an ideal conventional rect tube current function, and a typical conventional pseudo-rect tube current function.

Conventional high frequency X-ray generators produce pseudo-rect tube voltage (kV) and tube current (mA) functions (FIG. 4). A rect tube current function is generated if the X-ray tube current is instantly turned on at the start of an exposure, is constant during the entire period of the exposure and is instantly turned of at the end of the exposure. In a practical X-ray generator, the time required to turn the tube current and tube voltage on and off is on the order of one millisecond, and both the tube current and tube voltage vary slightly during the exposure, generally with less than 10% variation; therefore, we describe these functions as pseudo-rect. For true rect functions, gridline artifacts are eliminated when the product of X-ray exposure time and grid velocity is an exact integral multiple of the grid pitch ("P"). However, when the product of X-ray exposure time and grid velocity is not an exact integral multiple of the grid pitch, not all points on the image receptor are exposed to primary radiation for the same duration. This situation creates gridline artifacts. The conventional approach to solve this problem is either to move the grid through a large number (>20) of grid pitches, or to use such a small septum spacing that the grid line shadows are imperceptible.

Figure 5:
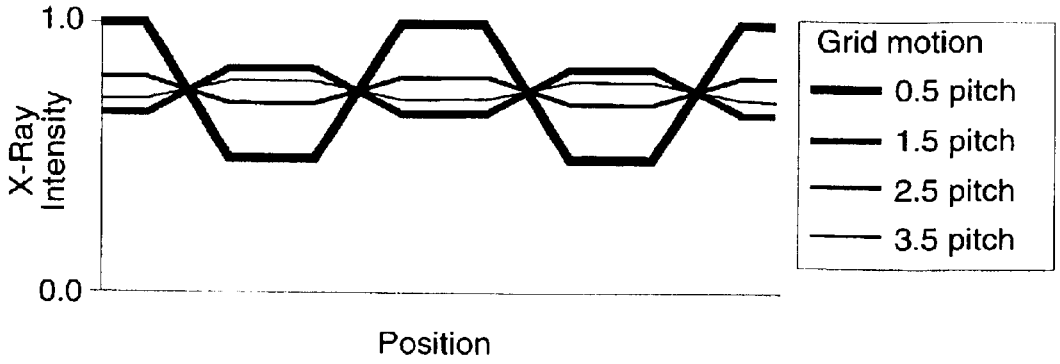
FIG. 5 is a graph illustrating the intensity profile generated through the use of the rect function of FIG. 4 for different values of the distance traveled by the anti-scatter grid during the X-ray exposure (described in terms of grid pitch, "P"). The y-axis indicates x-ray intensity relative to the maximum intensity for a stationary grid and the x-axis indicates position on the image receptor.

It is possible to calculate the intensity profile for a given form of the intensity function. The intensity function is the intensity of the primary x-ray radiation incident on a given point of the grid as a function of time. The intensity profile is the total primary radiation incident on the image receptor as a function of position integrated over the length of the exposure. Any variations in the intensity profile due to the grid can manifest as a gridline artifact. FIG. 5 shows the intensity profile calculated using a rect intensity function for different amounts of grid travel ranging from 0.5 to 3.5 grid pitches. As can be seen, the amplitude of the artifact falls off approximately as the reciprocal of the number of grid pitches traversed. It has long been established (H. E. Potter, *Am. J. Roent.*, Vol XXV, May 1931, pp. 677–683) that a grid motion of 20 grid pitches provides an adequate amount of gridline artifact suppression. However, as discussed above, such a large grid motion puts certain constraints on grid design. To maintain a compact grid housing and allow the grid to move 20 times the grid pitch requires that the grid pitch "P" be fairly small (a high grid density). Certain kinds of grids, such as articulated grids, are impractical to build with a fine pitch, so there is a need to design an X-ray imaging system that does not require a large grid motion.

Figure 6:
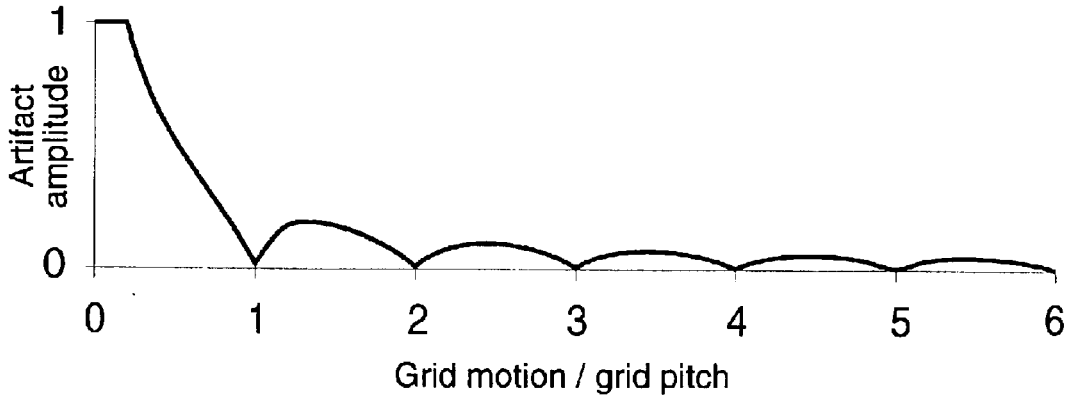
FIG. 6 is a graph illustrating the amplitude of the intensity profile generated through the use of the rect function of FIG. 4 as a function of the amount of anti-scatter grid travel. The y-axis indicates the amplitude of the intensity profile relative to the maximum x-ray intensity and the x-axis indicates the distance traveled by the grid relative to the grid pitch, "P".

The gridline artifact can be characterized as an amplitude; that is, the difference between the maximum and minimum primary radiation intensity across the receptor, divided by the maximum intensity present with a stationary grid. FIG. 6 shows the amplitude of the intensity profile calculated using a rect tube current function for different amounts of travel by the anti-scatter grid (calculated by dividing the distance the grid travels, or grid motion, by the grid pitch). The amplitude of the intensity profile generally decreases with increasing distance traveled, but is zero for specific values of the grid travel distance. As discussed above, it has long been known shown that the gridline artifacts are completely suppressed if the grid travels a distance equal to a positive integral number of grid pitches during the X-ray exposure. However, even a small error in the grid velocity can cause the grid to travel a distance not equal to a positive integral number of grid pitches, resulting in a visible gridline artifact. In addition, small errors in the tube current function and/or timing can also cause a visible gridline artifact.

One goal of the present disclosure is to suppress gridline artifacts when the anti-scatter grid moves through a short but arbitrary distance. This is accomplished by using a dynamic tube current function. We distinguish between dynamic functions, in which the parameter of interest (tube current or tube voltage) is varied or modulated by design, as opposed to stabilized or pseudo-rect functions, in which the design intention is to hold the parameter of interest at a constant value during the exposure. In practical X-ray generators, stabilized parameters often vary by several percent during an exposure.

In one embodiment, the dynamic tube current function is a symmetric trapezoidal function. However, other tube current functions can be used; in particular, any arbitrary function convolved with a rect function of the appropriate width will substantially eliminate gridline artifacts. The present disclosure thereby provides a means of suppressing gridline artifacts without requiring that the grid move through a large number of grid pitches, thus allowing the construction of relatively coarse grids. These grids can be made with a high grid ratio and high primary transmission at relatively low cost.

Figure 7:
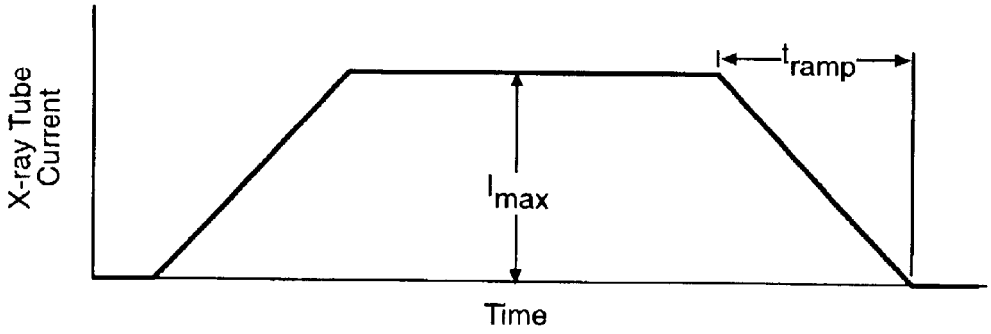
FIG. 7 illustrates a symmetric trapezoidal current function, with $t_{ramp}$ (the time taken for the function to reach the maximum current $I_{max}$) indicated.
Figure 8:
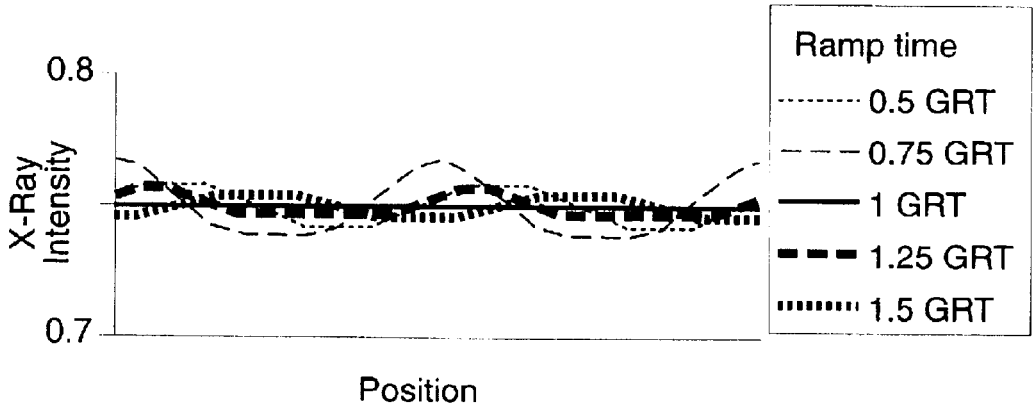
FIG. 8 is a graph illustrating the intensity profiles generated as the value of the ramp time $t_{ramp}$ of the symmetric trapezoidal current function of FIG. 7 is varied. The ramp times are described in terms of grid repeat time (GRT), which is calculated by dividing the grid pitch by the grid velocity. The y-axis indicates x-ray intensity relative to the maximum intensity and the x-axis indicates position on the image receptor. These profiles were calculated for a total grid distance traveled of 3.4 grid pitches.
Figure 9A:
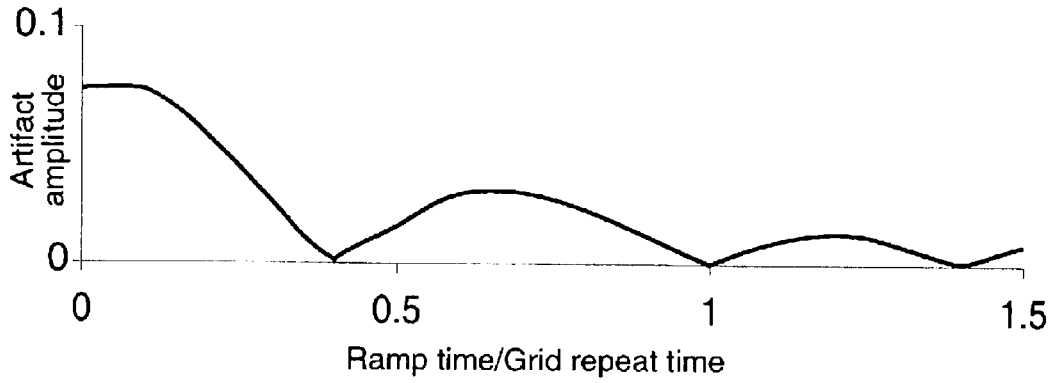
FIG. 9A is a graph illustrating the amplitude of the intensity profile as the ramp time $t_{ramp}$ of the symmetric trapezoidal current function of FIG. 7 is varied. The y-axis indicates the amplitude of the intensity profile relative to the maximum x-ray intensity and the x-axis indicates the ramp time $t_{ramp}$ relative to the grid repeat time (GRT). The profiles were calculated for a total grid distance traveled of 3.4 grid pitches. The amplitude has a value of zero when $t_{ramp}$ is N times the GRT (where N is a positive integer) or when $t_{ramp}$ is N +0.4 times the GRT (where N is a non-negative integer).

If the sharp edges of the rect function are changed to more gentle slopes, then the amplitude of the gridline artifact reduces. For example, FIG. 7 illustrates a symmetric trapezoidal current function. FIG. 8 shows a series of intensity profiles calculated using a symmetric trapezoidal current function for a total grid distance traveled of 3.4 grid pitches with various widths of the symmetric trapezoidal current ramp time ($t_{ramp}$). The width of $t_{ramp}$ is expressed in grid repeat time (GRT), which is calculated by dividing the grid pitch ("P") by the grid velocity. A GRT equal to 1 corresponds to the time for the grid to travel a distance of 1 grid pitch. Therefore, if $t_{ramp}$ is equal to 1, then the width of $t_{ramp}$ correspond to the time it takes the grid to move a distance equal to 1 grid pitch. FIG. 9A shows the amplitude of the gridline artifact as a function of the ramp time ($t_{ramp}$) when the total grid motion is 3.4 grid pitches. When the current ramp time ($t_{ramp}$) is exactly equal to the GRT, the gridline artifact disappears. In addition, the gridline artifact will disappear whenever either the current ramp time ($t_{ramp}$), or the difference between the current ramp time ($t_{ramp}$) and the total exposure time, is a positive integral multiple of the GRT, regardless of the total exposure time. When both conditions are true, an additional degree of gridline artifact suppression is obtained; this additional suppression can help minimize the effect of small errors in the grid velocity or tube current.

Figure 9B:
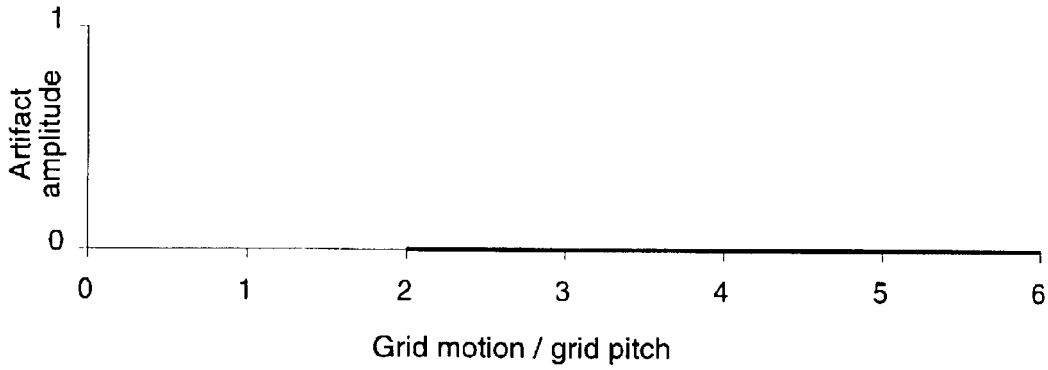
FIG. 9B is a graph illustrating the amplitude of the intensity profile generated using the symmetric trapezoidal tube current function of FIG. 7 as a function of the amount of anti-scatter grid travel. The profiles were calculated for a ramp time $t_{ramp}$ equal to the GRT. The y-axis indicates the amplitude of the intensity profile relative to the maximum x-ray intensity and the x-axis indicates the distance traveled by the grid relative to the grid pitch, "P". The amplitude is zero for all values of the grid travel.

FIG. 9B shows the amplitude of the intensity profile as a function of the amount of grid motion when the ramp time is set equal to the GRT. The intensity profile is zero for all grid motion of more than 2 grid pitches. Minimum length of this tube current function is 2 times the GRT, so motion of less than 2 grid pitches is not possible. A comparison of this figure to FIG. 6 shows the advantage of radiographic exposures taken using the process of the present disclosure.

The present discussion describes a dynamic tube current function with a stabilized tube voltage function. It is also possible to modulate the tube output by modulating both the tube current function and the tube voltage function during the exposure. Varying only the tube current function is preferred, since the intensity of radiation reaching the image receptor is proportional to the tube current regardless of the patient thickness or composition. In contrast, the radiation intensity at the image receptor is a non-linear function of the tube voltage, and the shape of the non-linear function changes with changes in patient thickness and composition. Thus, the task of suppressing the gridline artifacts by modulating the tube output is simplified when the tube voltage is stabilized during the exposure.

The use of dynamic tube output functions is not by itself novel. In 1931, Potter suggested the use of a trapezoidal "intensity" function to suppress gridline artifacts, a technique that he described as "feathering"(H. E. Potter, *Am. J. Roent.*, Vol XXV (May 1931), pp. 677–683). The current disclosure builds on Potter's suggestion in several ways. The first is the constraint on timing the intensity function and the grid repeat time. While Potter suggested that a minimum ramp time may be necessary to suppress gridline artifacts, he does not mention the possibility of completely suppressing gridline artifacts by matching the ramp time to the grid repeat time. The second improvement lies in the use of more practical functions. Designing a clinical system to follow a trapezoidal function is not trivial; in his paper, Potter admits to be unaware how to do so. In the present disclosure, we describe a broader class of functions that can be used to completely suppress the gridline artifacts; this class includes functions that unlike the trapezoid can be implemented using a modern x-ray generator by modulating the filament current. Finally, Potter refers to varying the x-ray "intensity", without reference to whether the tube current or the tube voltage is varied. As is described in the current disclosure, the intensity function seen by the image receptor varies with patient thickness, unless the tube voltage is held fixed.

Figure 10:
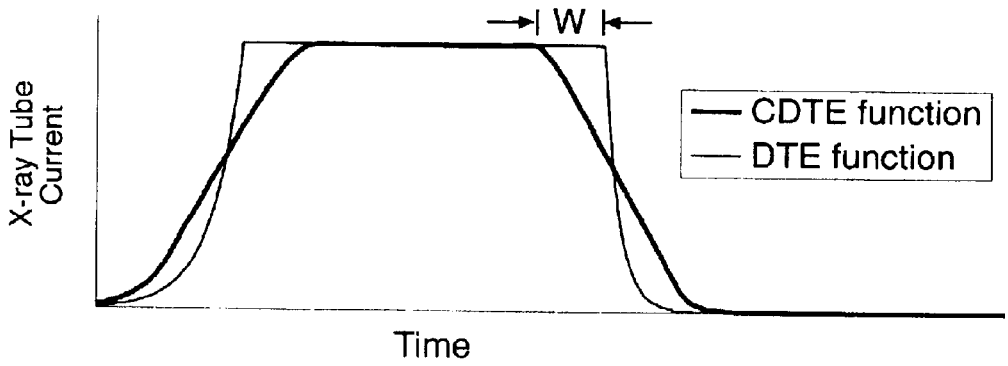
FIG. 10 is a graph illustrating a truncated dual exponential function (TDE function), and a TDE function convolved with a rect function of width W (CTDE function).
Figure 11:
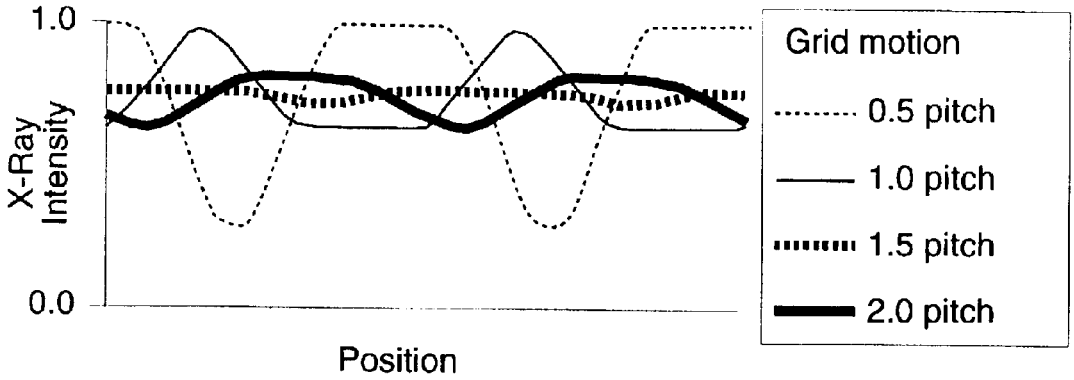
FIG. 11 is a graph illustrating the intensity profiles generated through the use of the TDE function of FIG. 10 for different values of the distance traveled by the anti-scatter grid (described in terms of grid pitch, "P"). The y-axis indicates x-ray intensity relative to the maximum intensity and the x-axis indicates position on the image receptor.
Figure 12:
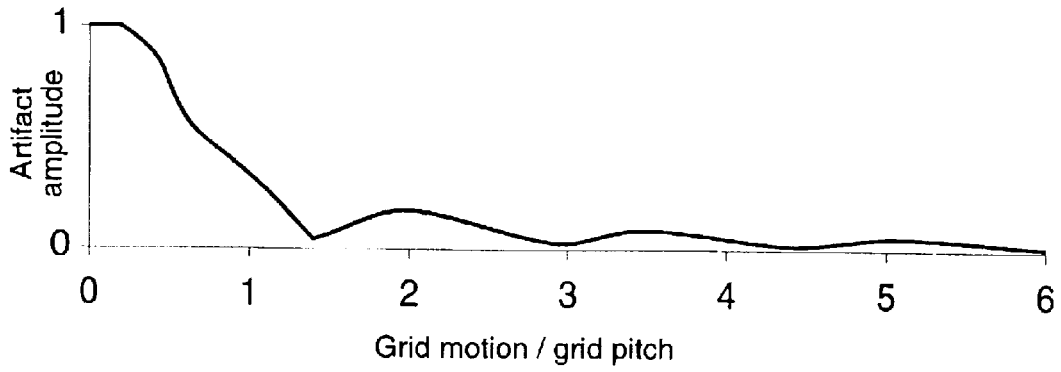
FIG. 12 is a graph illustrating the amplitude of the intensity profile generated through the use of the TDE function of FIG. 10 with different amounts of anti-scatter grid travel. The y-axis indicated the amplitude of the intensity profile relative to the maximum x-ray intensity and the x-axis indicates the distance traveled by the grid relative to the grid pitch, "P".

Other functions with soft edges are more suited for use as tube current functions than symmetric trapezoidal functions. One such function (the truncated dual exponential function) is shown in phantom in FIG. 10. This function has an exponential rising edge, a flat plateau, and an exponential falling edge. The rising edge is characterized by a time constant, and the falling edge is characterized by a different time constant, both of which may differ between X-ray tubes of different manufacture and model number. With the use of the proper time constants, this current function can be achieved on a typical X-ray tube by modulating the filament current. The time constants of the rising and falling edges can be set to match the characteristics of a given tube type. Typical intensity profiles at different amounts of grid motion calculated with the truncated dual exponential function are shown in FIG. 11. The amplitude of the gridline artifact intensity applying a truncated dual exponential function for different amounts of travel by the anti-scatter grid (calculated by dividing the distance the grid travels, or grid motion, by the grid pitch) is shown in FIG. 12. The truncated dual exponential function does not reduce the gridline artifact as was seen with the symmetric trapezoidal function (FIG. 7), and even at the minima of the function the amplitude of the intensity profile remains non-zero.

Figure 13:
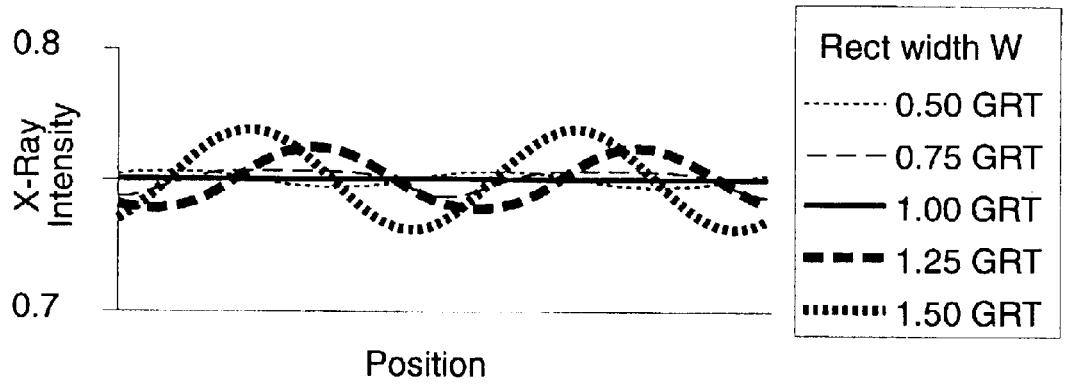
FIG. 13 is a graph illustrating the intensity profiles generated through the use of the CTDE function of FIG. 10 for different values of the width "W" of the rect function. The width "W" is described in terms of grid repeat time (GRT), which is calculated by dividing the grid pitch by the grid velocity. The y-axis indicates x-ray intensity relative to the maximum intensity and the x-axis indicates position on the image receptor. The profiles were calculated for a total grid distance traveled of 2.0 grid pitches.
Figure 14:
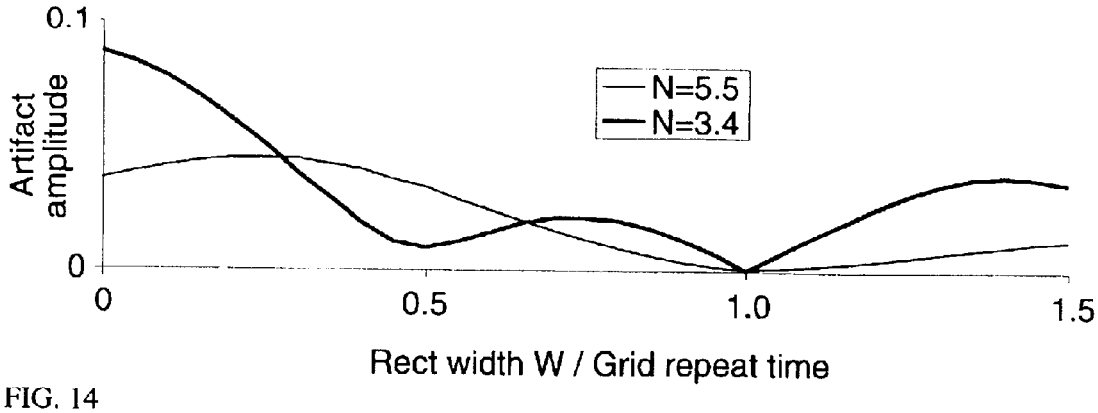
FIG. 14 is a graph illustrating the amplitude of the intensity profile as the width "W" of the rect function of FIG. 12 is varied. The y-axis indicates the amplitude of the intensity profile relative to the maximum x-ray intensity and the x-axis indicates the width of the rect function "W" relative to the grid repeat time (GRT). The calculations were performed for two values (3.4 and 5.5 grid pitches) of the total grid distance traveled. The amplitude has a value of zero when the width "W" of the rect function is N times the GRT (where N is any positive integer).

It is possible to smooth the tube current function by convolving it with a rect function. Convolution is a standard mathematical procedure (F. B. Hilderbrand, *Advanced Calculus for Applications*, Second Edition, 1976, Prentice-Hall, Inc., Edgewood Cliffs, N.J.). FIG. 10 shows the truncated dual exponential function before (in phantom) and after convolution with a rect function of width "W". FIG. 13 shows the intensity profile calculated for such a convolved tube current function for different widths of the convolving rect function (expressed in GRT). In FIG. 13, the total distance traveled by the grid is 2 grid pitches. FIG. 14 illustrates the amplitude of the intensity profile as a function of the convolving rect function width "W". When the width of the convolving rect function is equal to the grid repeat time, the grid artifact disappears entirely for any grid motion of more than the grid pitch. This effect is similar to artifact suppression seen with the symmetric trapezoidal function (FIG. 9B). It should be possible to improve the robustness of the gridline artifact suppression by careful optimization of the tube current function and the grid velocity. FIG. 14 shows calculations for a total grid travel of both 3.4 and of 5.5 grid pitches. Clearly, the latter case is more robust against errors in the convolution width, and is likely more robust against errors in other parameters.

Gridline artifacts should be entirely suppressed whenever the tube current function is equal to any function with a finite time integral convolved with a rect function whose width is equal to a positive integral of the grid repeat time, for any exposure time larger than the GRT. For example, a symmetric trapezoidal function may be considered a rect function convolved with a rect function; when either one of the rect functions has the appropriate width, then the gridline artifacts are completely suppressed. In this case, the ramp time $t_{ramp}$ is given by the width "W" of the narrower of the two rect functions.

This phenomenon is one foundation of the current disclosure. By modulating the tube current function in an appropriate way it is possible to completely suppress the gridline artifact for any exposure time greater than the GRT. When the grid velocity is constant, one class of tube current functions that does this is generated by convolving an arbitrary function by a rect function with a width equal to a positive integer multiple of the GRT. Equivalently, any tube current function whose Fourier transform has zero amplitude at all frequencies equal to all positive integer multiples of the reciprocal of the GRT will completely suppress the gridline artifact if the grid velocity is constant during the exposure. There is a more general rule for gridline artifact suppression that includes situations where the velocity changes during the exposure; this rule is described in Example 1 of these specifications, and in a paper published by the inventors (D. M. Gauntt and G. T. Barnes, submitted to *Med. Phys.,* 2002).

Typical specifications of a compact, high ratio, high primary transmission anti-scatter grid for use in general radiography according to the present disclosure are listed in Table 1.

TABLE 1 specifications of one embodiment of the anti-scatter grid system of the present disclosure

| | Upper grid | Lower grid |
|---|---|---|
| Grid Type | Fixed focused linear | Articulated focused linear |
| Grid motion | None | Linear articulation |
| Grid ratio | 5:1 | 20:1 |
| Focal length | 125 cm | 100 . 150 cm |
| Line density | 60 lines/cm | 2.5 lines/cm |
| Interspace material | Aluminum | Air |
| Septa material | Lead | lead-steel composite |
| Cover material | Aluminum | Mylar (top only) |
| Grid thickness | ~1 mm | ~70 mm |
| Septa width (d) | 0.040 mm | 0.65 mm |
| Interseptum width (D) | 0.127 mm | 3.35 mm |

Figure 16:
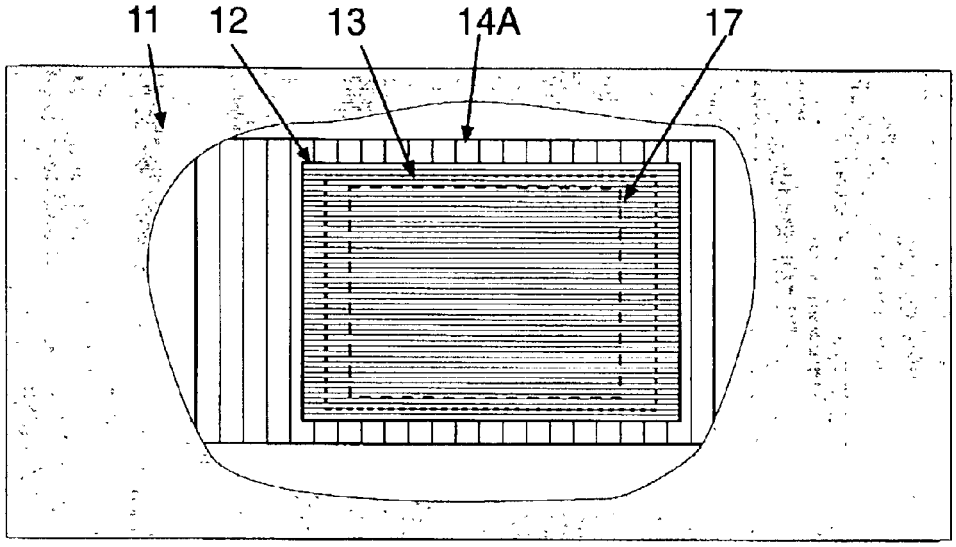
FIG. 16 is a cut-away top view of one embodiment of an anti-scatter grid assembly according to the present disclosure, incorporating pendulous motion.
Figure 19:
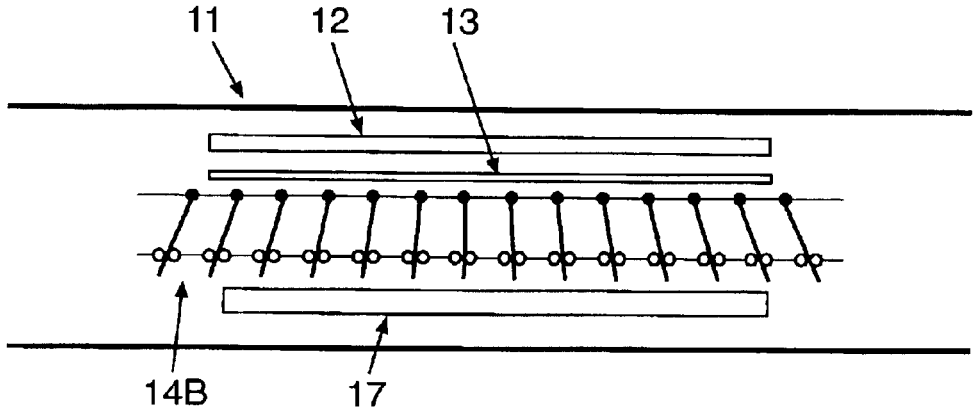
FIG. 19 is a cut-away side view of one embodiment of the anti-scatter grid system of the present disclosure, incorporating linear, articulating motion.

In the embodiment described in Table 1, the grid system consists of two grids mounted such that the septa of the upper grid are aligned transversely to the septa of the lower grid (see FIGS. 16, and 19). The upper grid 12 is stationary with a sufficiently high line density that the septa are not visible on the final image. The upper grid 12 is a low-ratio grid, and removes most of the scattered radiation, so the radiation intensity measured by the AEC sensor 13 is a fairly accurate estimate of the radiation intensity incident on the image receptor 17. Because the upper grid 12 is a low ratio grid, its transmission is largely insensitive to variations in grid alignment, and in particular to variations in the distance from the x-ray focus (not shown) to the image receptor 17. The lower grid 14 is a high ratio, articulated grid. This grid removes most of the remainder of the scattered radiation, including radiation scattered by the AEC sensor. Because it is a high-ratio grid, its transmission is sensitive to variations in grid alignment. The system therefore responds to variations in the focal spot position and the grid position by articulating the grid, as described later. Because it is an articulated grid, it has a fairly low line density (large grid pitch "P"), and so it must be moved to minimize gridline artifacts. Because of the coarseness of the grid, it is impractical to move it many multiples of the grid pitch, so it is preferable to modulate the tube current according to the present disclosure in order to prevent gridline artifacts.

While it is appreciated that a grid according to the present disclosure is readily constructed having values that differ from those given in Table 1, it is preferred that the width of the interspace material ("D") is more than 8 times greater than the width of the radiopaque septa ("d") in order to achieve superior primary X-ray transmission, and therefore, superior dose efficiency. The thickness and material of the septa should also be sufficient to effectively eliminate X-ray transmission through the septa.

In one embodiment, the high ratio grid according to the present invention is flat. In an alternate embodiment, the grid is curved. Whether the grid is flat or curved, the grid will preferably have septa focused to the appropriate X-ray focus-grid distance. In one embodiment, the flat grid is mounted in a Bucky assembly on a curved track, with the curved track having a radius of curvature corresponding to the X-ray focus-grid distance. This allows the grid to remain focused on the X-ray focus while moving transversely. In an alternate embodiment, the grid may be mounted on a linear track, but be built in such a way that the individual septa articulate within the grid to remain focused on the X-ray focus. The articulation can be designed to allow the focal length of the grid to vary. This is important because in general radiographic systems, the distance from the X-ray focus to the image receptor (known as the source-image distance, or SID) varies from application to application. Optimally, the focal length of the grid should be equal to the SID minus the distance from the grid to the image receptor. As the SID varies, it becomes impossible for all septa of a grid with fixed focal length to remain aligned with the X-ray focus; the result is an image artifact known as a cutoff artifact. As the grid ratio of a grid increases, it becomes increasingly sensitive to variations in SID. Therefore, while the low ratio grids used in general radiography today can be used with a wide variety of values of the SID, a much higher ratio grid would need to have a variable focal length in order to be useful over a range of SID.

Generally, the distance between the septa of the grid is fixed while the grid is moving and the image receptor is exposed to X-rays. In one embodiment, the top surface of the septa will be bonded to a thin radiolucent sheeting material such as Mylar (DuPont de Nemours Co.) or a thin carbon fiber composite in order to maintain septal spacing and damp vibrations within the grid. In the case of articulating grid septa, small tabs on the top of the grid slats may be designed to extend through corresponding holes in the radiolucent sheet. In the case of non-articulating grid septa, the damping may be accomplished alternatively by using an interspace material with X-ray attenuation approaching that of air, such as aerogels or polymer foams.

Figure 15:
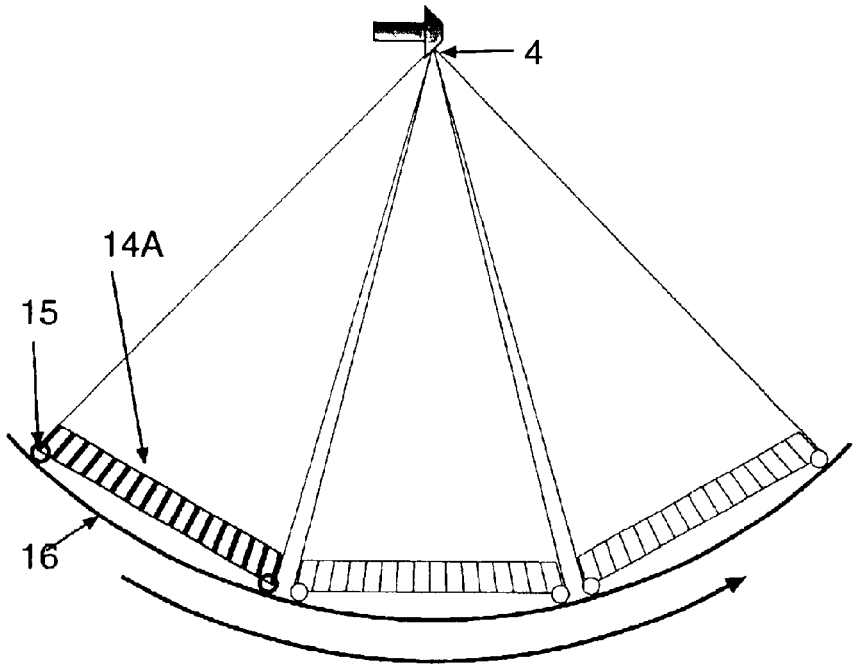
FIG. 15 is a schematic diagram of one embodiment of the fixed anti-scatter grid incorporating pendulous motion according to the present disclosure, with grid motion grossly exaggerated for clarity.
Figure 17:
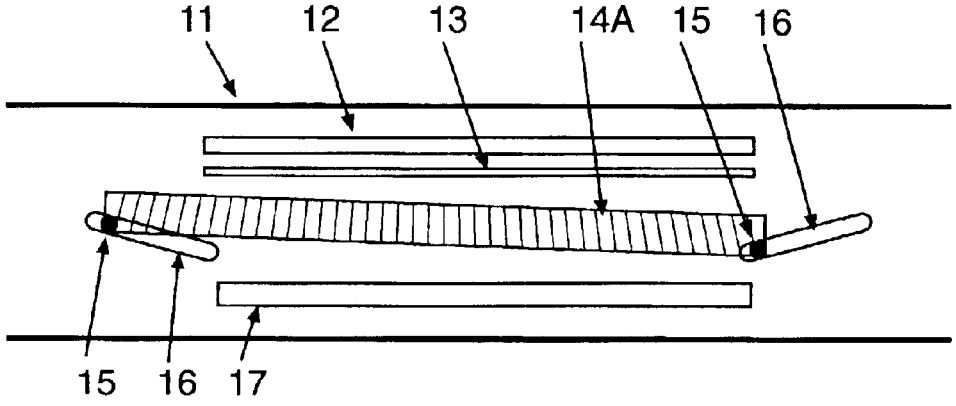
FIG. 17 is a cut-away side view of one embodiment of an anti-scatter grid assembly according to the present disclosure, incorporating pendulous motion.

One embodiment of the present invention is shown in FIGS. 15, 16 and 17. As shown in FIG. 15, a fixed focal-length high-ratio anti-scatter grid 14A is equipped with bearings 15 that ride along a curved guide track 16. The starting position of the grid 14A is indicated, with intermediate and finishing positions shown in phantom. The center of curvature of the track 16 is coincident with grid focal axis, which passes through the X-ray focus 4. A drive means (not shown) moves the grid 14A at a constant angular velocity along the track 16. As the grid 14A is driven along the track 16, the grid remains aligned on the X-ray focus 4. The amount of motion is exaggerated for clarity. In practical medical radiology applications, a grid 14A according to the present disclosure will rotate through an arc of approximately 0.5° to 2°. Because the focal length of the high ratio grid in this embodiment is fixed, its application would be limited to radiographic systems dedicated to uses where the SID is never varied, such as chest radiography.

As shown in FIG. 17, incident X-rays pass through the examination table top 11 and encounter a low-ratio, high-line density fixed grid 12. The low-ratio grid 12 removes many of the scattered X-rays. The AEC sensor 13 then measures the intensity of the radiation. The remaining X-rays then pass through the high-ratio grid 14A which is mounted with its focal axis orthogonal to the low-ratio grid 12. The high-ratio grid 14A removes most of the remaining scattered X-rays, including scattered X-rays generated by the AEC sensor 13. The image receptor 17 then receives the remaining X-rays, producing an X-ray image. The image receptor 17 may be of any type or design, including, but not limited to, a digital sensing array or a screen-film cassette. The high ratio anti-scatter grid 14A is equipped with bearings 15 which are configured to engage the curved guide tracks 16. In an alternate embodiment, the tracks 16 may be straight, but angled so that a normal through the center of each track passes through the focal spot. Throughout the motion of the grid, including the extreme end of motion (as shown in FIG. 17), the anti-scatter grid 14A completely covers the image receptor 17.

An alternate embodiment of the high ratio, anti-scatter grid of the present disclosure is shown in FIGS. 18 through 21. As illustrated in FIG. 19, incident X-rays pass through the examination table top 11 and encounter a low-ratio, high-line density fixed grid 12. The low-ratio grid 12 removes many of the scattered X-rays. The AEC sensor 13 then measures the intensity of the radiation. The remaining X-rays then pass through the scanning, articulating, high-ratio grid 14B which is mounted with its focal axis orthogonal to the low-ratio grid 12. The high-ratio grid 14B removes most of the remaining scattered X-rays, including scattered X-rays generated by the AEC sensor 13. The image receptor 17 then receives the remaining X-rays, producing an X-ray image. The image receptor 17 may be of any type or design, including, but not limited to, a digital sensing array or a screen-film cassette. Because the high ratio grid in this embodiment is an articulating grid, it can be designed to vary its focal length, and therefore this embodiment is well suited for use in general radiographic systems where the SID can vary from application to application.

Figure 18:
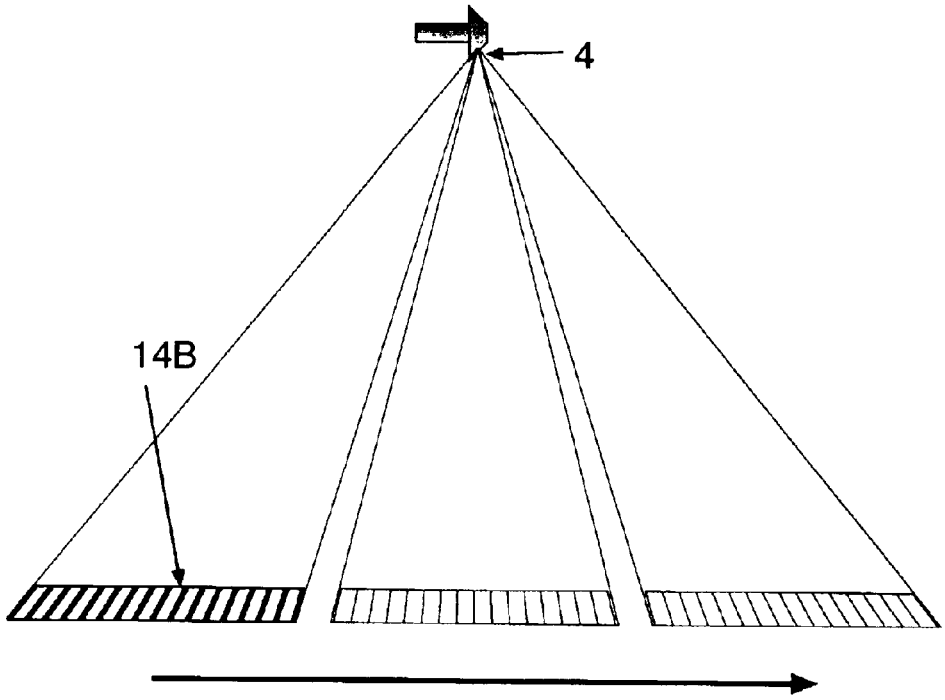
FIG. 18 is a schematic diagram of one embodiment of the articulating anti-scatter grid incorporating linear motion according to the present disclosure, with grid motion grossly exaggerated for clarity.
Figure 20:
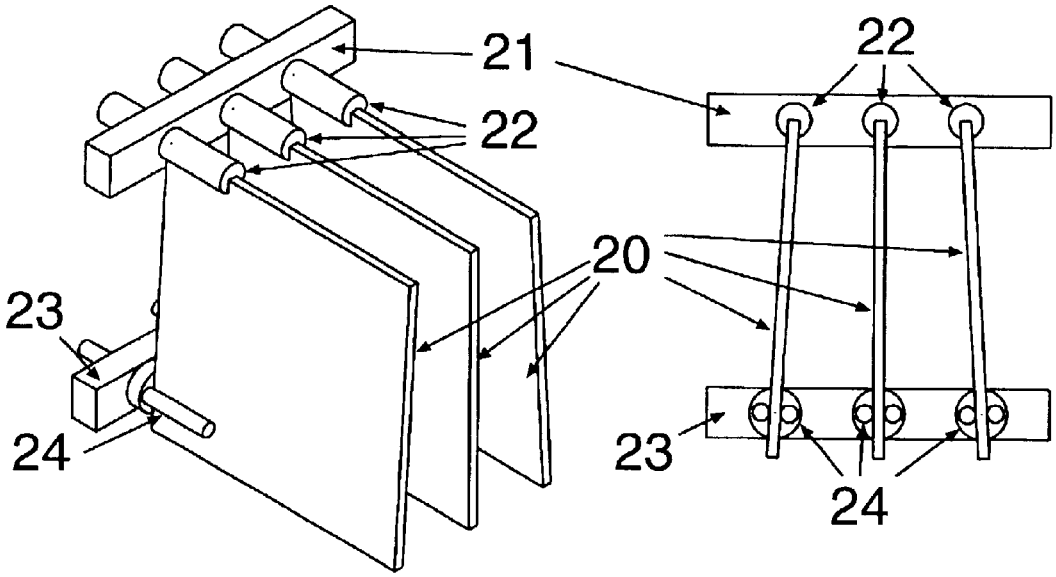
FIG. 20 is a detail isometric and cut-away side view of the articulated grid, showing the septa support structure at one end.
Figure 21:
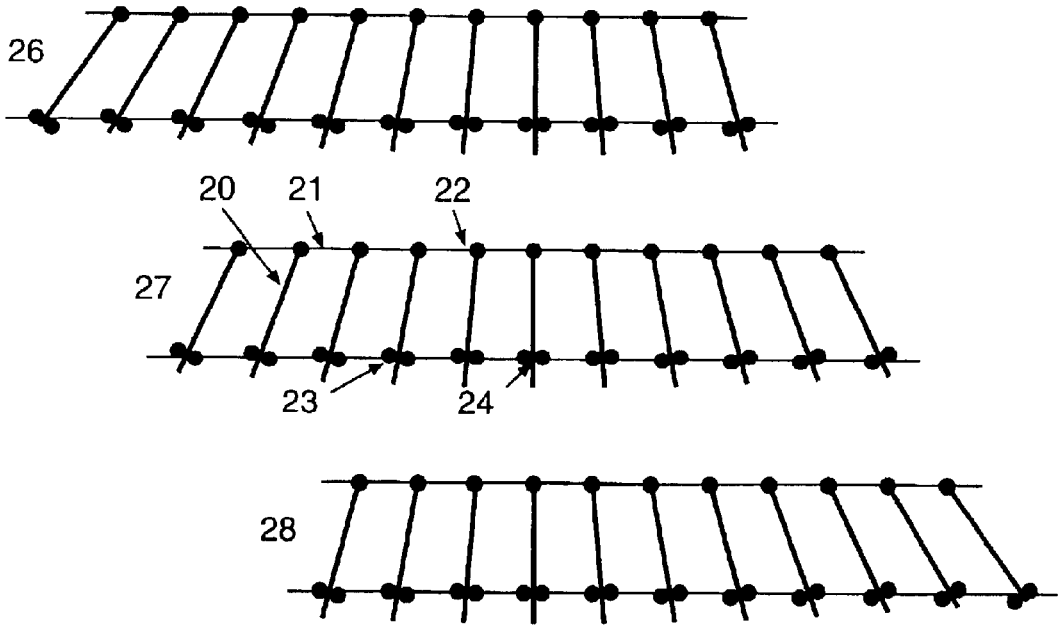
FIG. 21 is a detail side view of one embodiment of the high-ratio articulating grid, demonstrating the ability of the articulating grid to remain aligned on the x-ray focus while moving laterally.
Figure 22:
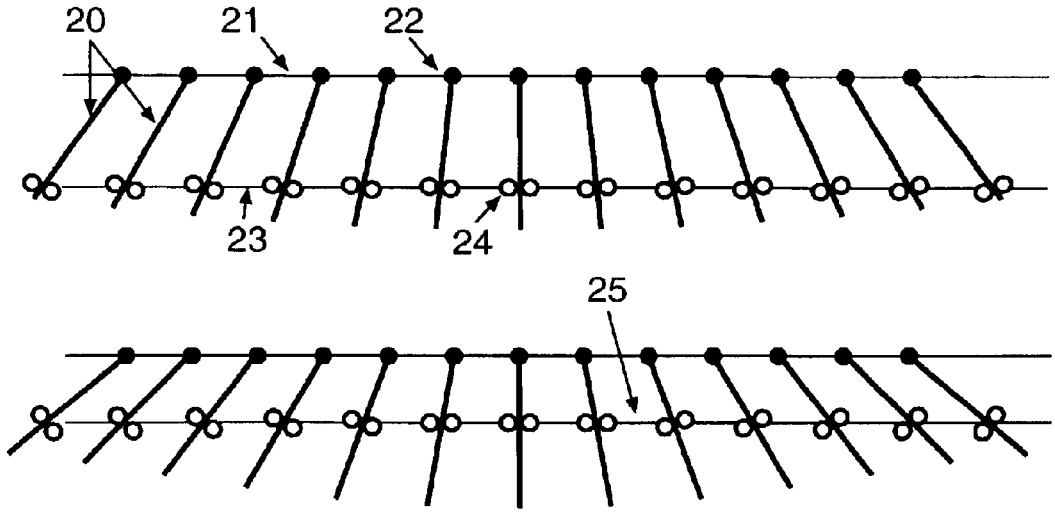
FIG. 22 is a side view of one embodiment of the high-ratio articulating grid, demonstrating the ability of the articulating grid to adapt to different focal lengths.

FIGS. 18 and 20 through 22 show the articulation of the high-ratio grid 14B. FIG. 18 shows how the articulating grid stays aligned on the focal spot while moving. As illustrated in FIG. 20, the high-ratio grid 14B is composed of a series of anti-scatter septa 20 which are mounted by a first hinge means 22 to an upper support 21. The septa 20 are connected to a lower support 23 by a second hinge means 24. The first hinge means 22 are mounted fixedly to the septa 20. The second hinge means 23 may be sliding pins or rolling pins. The septa 20 remain aligned on the focus by moving the lower support 21 and the upper support 23 transversely by different amounts as shown in FIG. 21. Similarly, the septa 20 can be focused to a different focal length by moving the lower support 23 to a new location 25, as illustrated in FIG. 22. Through this mechanism, the high-ratio grid 14B can accommodate variations in the grid to focus distance One feature of the present disclosure is the use of a dynamic tube output function in combination with the anti-scatter grid described during exposure of the image receptor. Representative tube output functions are presented in FIGS. 7 and 10. Other functions may be used as discussed below, with the functions disclosed being exemplary and not intended to limit the scope of the disclosure. As discussed above, if the time W is a positive integral multiple of the GRT, then the gridline artifact is completely suppressed for any exposure time greater than GRT. The GRT has been defined above as the grid pitch divided by the grid velocity. The GRT may also be thought of as the time taken for the shadows of the grid lines to move the same distance as the separation between shadows. Even with other values of W, the gridline artifact would be considerably smaller than with a conventional rect function, so long as W is not much less than the grid repeat time.

There are multiple ways to achieve the dynamic functions described. One technique would be to hold the tube voltage fixed while varying the tube current, either by varying the voltage on a control grid that shields the cathode from the anode or by varying the filament current. The former technique has the advantage of a rapid response to the control signal, so the symmetric trapezoidal function described above could be generated very accurately. However, gridded tubes are more expensive than conventional tubes to design and produce. It is possible to vary the filament current with conventional tubes, but the response of the tube current to changes in filament current is slower, and may require the use of a dynamic function other than the symmetric trapezoidal function (FIG. 7), such as, but not limited to, the convolved truncated dual exponential function (FIG. 10). However, any function that has zero frequency components at positive integer multiples of the reciprocal of the grid repeat time will completely suppress gridline artifacts. Any function that is equal to the convolution of an arbitrary function with a rect function whose width is a positive multiple of the grid repeat time will fit this criterion, and its use will completely suppress gridline artifacts.

The use of tube output modulation has been described here for use with linear grids, in which the septa are all parallel to each other. In principle it can be used with any grid that has a septum pattern that is periodic with linear or angular distance in the direction of the grid motion. This includes cellular grids, in which multiple sets of septa intersect each other to produce a pattern of radiolucent cells. Examples of patents teaching cellular grids are U.S. Pat. Nos. 1,164,987 and 5,606,589.

EXAMPLE 1

The following is a mathematical description of the theory behind gridline artifact suppression as described in the present disclosure.

Figure 1:
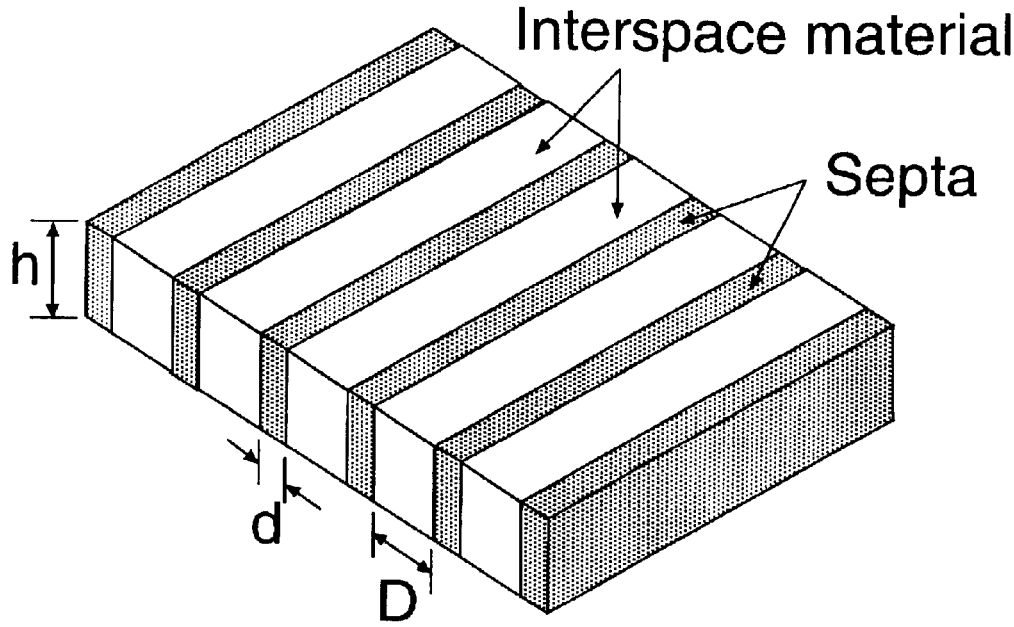
FIG. 1 is a schematic view of a conventional anti-scatter grid.
Figure 2A:
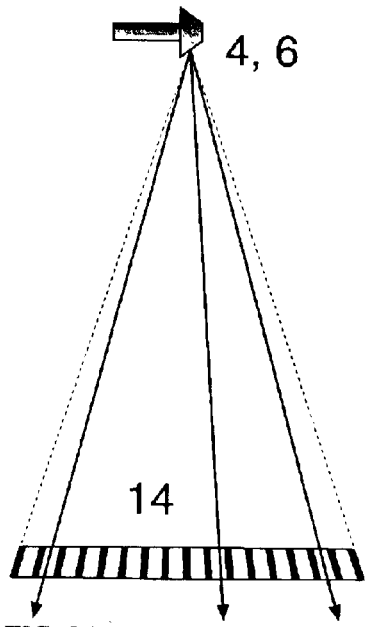
FIG. 2A is a schematic view of a focused anti-scatter grid aligned with an X-ray focus.
Figure 2B:
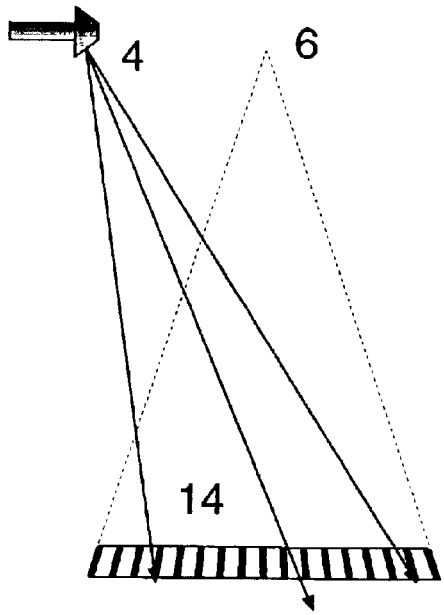
FIG. 2B is a schematic view of a focused anti-scatter grid not aligned with an X-ray focus.

Suppose that a system incorporates a stationary anti-scatter grid located immediately over the image receptor, and that the x-ray intensity falling on the anti-scatter grid is uniform. In such a system, the x-ray flux density (i.e. the number of x-rays per area) falling on the image receptor would be $$\psi(x,y)=\Phi_0 I_0 t_{exp} T_{grid}(x) \tag{1}$$

where the grid transmission $T_{grid}(x)$ is shown in FIG. 2, $t_{exp}$ is the exposure time, $I_0$ is the tube current, and $\Phi_0$ is the x-ray intensity (x-rays per area per second per mA) measured without a grid. It is important to note that the grid transmission function $T_{grid}$ is periodic, with period P called the grid pitch. While the incident x-ray intensity is uniform, the flux density after the grid is not and so a series of gridline shadows falls on the image receptor. In some x-ray systems, such as fluoroscopic systems, the spatial resolution of the image receptor is relatively poor. In these systems, it is possible to use a stationary anti-scatter grid with septa so closely spaced that they are not visible to the image receptor.

In other systems, the gridline shadows would appear in the final image as gridline artifacts. In these systems, the grid is moved during the exposure in order to blur out the grid lines. Since the x-ray flux rate at each point changes during the exposure, we need to integrate the flux rate over the exposure time:

$$\Psi(x, y) = \Phi_0 Q F_{grid}(x) \tag{2}$$

$$F_{grid}(x) \equiv \int_0^{t_{exp}} T_{grid}(x - x_C(t))i(t)\,dt$$

$$Q \equiv \int_0^{t_{exp}} I(t)\,dt$$

$$i(t) \equiv \frac{I(t)}{Q}$$

where $x_c(t)$ is the position of the center of the grid at time t. Note that we now allow the tube current I(t)=Q i(t) to change during the exposure. The function i(t) describes the tube current variation, and has a time integral of 1. The dimensionless function $F_{grid}(x)$ is analogous to the grid transmission. For the case where the tube current is constant and the grid is stationary, equation (2)reduces to equation (1).

Most importantly, if the function $F_{grid}(X)$ is independent of x, then the grid is invisible to the image receptor and there is no grid line artifact. Otherwise, it adds to the image strips running in the y-direction.

The function $F_{grid}(x)$ can be rewritten in terms of a mathematical entity called a convolution, indicated by a * symbol:

$$F_{grid}(x) = \int_0^{t_{exp}} T_{grid}(x - x')\frac{i(t_C(x'))}{v(x')}\,dx' \tag{3}$$

$$= T_{grid}(x) * \left(\frac{i(t_C(x))}{v(x)}\right)$$

$$v(x') \equiv \frac{dx'}{dt}$$

where v(x') is the grid velocity when the center of the grid is at position x', and $t_c(x')$ is the time when the center of the grid is at position x'.

It is possible to suppress the gridline artifacts entirely for any amount of grid motion more than 1 grid pitch. This is done by making use of the periodic nature of the grid shadow $F_{grid}$. One characteristic of a periodic function with period P is that the average of the function over any domain of width P is the same, regardless of the location of the center of the domain. To put it another way, the function $G_{grid}$ $$G_{grid}(x) = \frac{1}{P}\int_{x-P/2}^{x+P/2} F_{grid}(x')\,dx' \tag{4}$$

is independent of x. Equation (4) can be rewritten as a convolution over a rect function R:

$$G_{grid}(x) = \frac{1}{P}\int_{-\infty}^{\infty} F_{grid}(x')R\left(\frac{x-x'}{P}\right)dx' \tag{5}$$

$$= \frac{1}{P}F_{grid}(x) * R\left(\frac{x}{P}\right)$$

$$R(x) \equiv \begin{cases} 1 & |x| < 0.5 \\ 0 & \text{otherwise} \end{cases}$$

If we combine equations (5) and (3), we get $$G_{grid}(x) = \frac{1}{P}\left(T_{grid}(x) * \left(\frac{i(t_C(x))}{v(x)}\right)\right) * R\left(\frac{x}{P}\right) \tag{6}$$

One property of convolutions is that the order in which they are evaluated can be changed without affecting the final result, so $$G_{grid}(x) = T_{grid}(x) * i'(x) \tag{7}$$

$$i'(x) \equiv \frac{1}{P}\left(\frac{i(t_C(x))}{v(x)}\right) * R\left(\frac{x}{P}\right)$$

Therefore comparing Equations (3) and (7), we see that when the tube current is described by $$i(t) = v(t)h(x_C(t)) \tag{8}$$

$$h(x) \equiv \frac{1}{P}\left(\frac{g(x)}{v(x)}\right) * R\left(\frac{x}{P}\right)$$

for some arbitrary function g(x), then Ggrid(x) is the moving grid transmission function $F_{grid}$. Since $G_{grid}$ is independent of x, the image is free of gridline artifacts.

When the grid velocity is constant, then $x_c(t) = vt$ and equation (8) simplifies to $$i(t) = \frac{1}{P}g(vt) * R\left(\frac{vt}{P}\right) \tag{9}$$

By applying a Fourier transform to either side of Equation (8), we can show a more fundamental constraint on the function h(x):

$$H(k) = FT\left(\frac{g(x)}{v(x)}\right)\text{sinc}(\pi k P) \tag{10}$$

$$H(k) \equiv FT(h(x))$$

The sinc function will be equal to zero at all frequencies that are multiple integrals of 1/P. In general, the gridline artifacts will be completely suppressed if the tube current is exactly equal to the function v(t) $h(x_c,(t))$, where the Fourier transform H(k) of h(x) has zeroes at all frequencies k that are proportional to the reciprocal of the grid pitch P.

What is claimed:

1. A process for producing a detected X-ray image of a subject, the process comprising the steps of:

a) directing an X-ray beam produced by an X-ray tube, characterized by an output function comprising an X-ray tube current function and an X-ray tube voltage function, from a focus of the X-ray tube through the subject so that the beam impacts an image receptor to produce the detected X-ray image, where the intensity of primary X-ray radiation at a given point on the image receptor is characterized as a function of time by an image intensity function;

b) placing a first grid between the subject and the image receptor, the first grid being an anti-scatter grid characterized by a grid transmission function that is a periodic function of position, characterized by a grid pitch;

c) producing a grid motion by moving the grid at a velocity during an X-ray exposure, the velocity characterized as a velocity function; and d) modulating the output function such that for some thickness and composition of the subject, the image intensity function is substantially equal to the function i(t) defined by the equation $$i(t) = v(t)h(x_C(t))$$

$$h(x) \equiv \left(\frac{g(x)}{v(x)}\right) * R\left(\frac{x}{nP}\right)$$

where $x_C(t)$ is the position of the center of the anti-scatter grid at time t, the velocity function v(x) is the velocity of the grid when the center of the anti-scatter grid is at position x, g(x) is an arbitrary function with a finite integral over x and has zero value outside a finite domain of x, h(x) is non-negative for every value of x, R(x) is the rect function, n is a positive integer, and P is the grid pitch.

2. The process of claim 1 where the velocity function is substantially constant during the X-ray exposure, the tube voltage function is substantially constant during the X-ray exposure, the tube current function is modulated by varying a tube current, and the grid motion is characterized by a grid repeat time, where the grid repeat time is equal to the grid pitch divided by the grid velocity.

3. The process of claim 2 where the tube current function is modulated by varying a filament current of the X-ray tube.

4. The process of claim 2 where the tube current function is modulated by varying a voltage of a part of the X-ray tube selected from the group consisting of: a control grid and a bias cup.

5. The process of claim 2 where the tube current function has a Fourier transform that has a negligible amplitude at all frequencies equal to positive multiples of the reciprocal of the grid repeat time.

6. The process of claim 2 where the tube current function is substantially equal to a convolution of an arbitrary function with a rect function having a width substantially equal to an integer multiple of the grid repeat time.

7. The process of claim 2 where the tube current function is a symmetric trapezoidal function having a ramp time substantially equal to a positive integer multiple of the grid repeat time.

8. The process of claim 2 where the tube current function is a convolved dual symmetric trapezoidal function.

9. The process of claim 1 where the output function is modulated by using a dynamic tube current function and a pseudo-rect tube voltage function.

10. The process of claim 1 where the output function is modulated by using a dynamic tube current function and a dynamic tube voltage function.

11. The process of claim 1 where the output function is modulated by using a pseudo-rect tube current function and a dynamic voltage function.

12. The process of claim 1 where the velocity function is substantially constant during the X-ray exposure.

13. The process of claim 1 where the velocity function varies during the X-ray exposure.

14. The process of claim 1 where the first grid comprises a) a plurality of radio-opaque septa, interspersed with a radiolucent interspace material; and b) a means to move the grid during the X-ray exposure to produce the grid motion at the velocity.

15. The process of claim 14 where the width of the interspace material is greater than 8 times the width of the septa.

16. The process of claim 14 wherein the grid motion is linear.

17. The process of claim 14 wherein the first grid further comprises a focusing means to keep the grid aligned on the focus during the grid motion.

18. The process of claim 14 wherein the first grid comprises one set of radio-opaque septa, where the septa are substantially parallel to each other and are substantially aligned with the focus.

19. The process of claim 14 where the focusing means comprises a mechanism that moves the first grid in an arc whose center is substantially coincident with a grid focal axis, the first grid is periodic in an angular distance relative to the grid focal axis, and the velocity function describes an angular velocity of the grid about the grid focal axis.

20. The process of claim 19 wherein the focusing means comprises a plurality of bearings mated to the first grid and a plurality of curved guide tracks, the bearings configured to engage the plurality of curved guide tracks, where the focus and a center of curvature of each curved guide track are substantially coincident with the grid focal axis.

21. The process of claim 19 wherein the focusing means comprises a plurality of bearings mated to the first grid and at least two straight guide tracks, the bearings configured to engage the at least two straight guide tracks, the at least two straight guide tracks positioned such that a line normal to each track at a point where the bearings contact the track at a center of motion of the grid passes substantially close to the focus.

22. The process of claim 14 where the focusing means comprises an articulating mechanism which articulates the septa individually to keep the septa focused on the focus, the grid motion is linear in a plane substantially parallel to the image receptor, the grid transmission function is periodic in linear distance in the direction of motion, and the velocity function describes a linear velocity of the grid.

23. The process of claim 22 where the articulating mechanism comprises an upper support, a lower support, a first hinge means to moveably attach the septa to the upper support and a second hinge means to moveably attach the septa to the lower support and the articulating mechanism moves the upper support a first distance and the lower support a second distance.

24. The process of claim 23 where the first distance and the second distance are not the same.

25. The process of claim 23 where the ratio of the first distance to the second distance is equal to a distance from the focus to the upper support divided by a distance from the focus to the lower support.

26. The process of claim 14 where the interspace material is air, polymer foam or aerogel.

27. The process of claim 14 wherein the first grid comprises two sets of radio-opaque septa, where the septa within each set are substantially parallel to each other and oriented to align with the focus, and the septa and a focal axis of the first set of septa are substantially perpendicular to the septa and a focal axis of the second set of septa.

28. The process of claim 14 wherein the first grid comprises a plurality of radio-opaque sheets having a plurality of holes perforating the sheets, the sheets stacked so the holes are aligned with each other and with the focus.

29. The process of claim 28 wherein the focusing mechanism consists of a mechanism that moves the radiopaque sheets individually to keep them oriented on the focus.

30. The process of claim 28 wherein the pattern of holes in the plurality of sheets is periodic in the direction of the grid motion, and is periodic either in a linear position or in an angular position on the sheet.

31. The process of claim 28 wherein the shape of the holes in the plurality of sheets is selected from the group consisting of: hexagonal, square, and triangular.

32. The process of claim 14, further comprising the step of placing an automatic exposure control sensor in a position selected from the group consisting of: between the first grid and the image receptor and after the image receptor.

33. The process of claim 14, further comprising the step of using the image receptor as an automatic exposure control sensor.

34. The process of claim 14, further comprising the step of placing a second grid between the subject and the image receptor, the second grid being an anti-scatter grid having a focal axis substantially perpendicular to a focal axis of the first grid.

35. The process of claim 34, further comprising the step of placing an automatic exposure control sensor in a position selected from the group consisting of: between the first grid and the second grid, after the first and second grids but before the image receptor and after the image receptor.

36. The process of claim 34, further comprising the step of using the image receptor as an automatic exposure control sensor.

37. The process of claim 35, wherein the order of the components is: the subject, the second grid, the automatic exposure control sensor, the first grid and the image receptor.

38. The process of claim 34, wherein the second grid has a line density greater than 50 septa per cm, and the septa of the second grid have a fixed position.

39. The process of claim 34 further comprising moving the second grid to produce a second grid motion, the second grid motion being substantially perpendicular to the first grid motion, and the second grid having a grid repeat time equal to the grid repeat time of the first grid.

40. The process of claim 34, wherein the second grid has a grid ratio less than 8:1.

41. The process of claim 34, wherein the second grid is an articulating grid having a focal length that may be varied.

42. The process of claim 14 where the spacing between the septa is maintained by a thin radiolucent sheet fixedly attached to the edges of the septa.

43. The process of claim 14 where the spacing between the septa is maintained by a thin radiolucent sheet pivotally attached to the edges of the septa.

* * * * *